US007100527B2

(12) United States Patent
Munro

(10) Patent No.: US 7,100,527 B2
(45) Date of Patent: Sep. 5, 2006

(54) WATERCRAFT MOORING DEVICE

(76) Inventor: Robert Alexander Munro, 24 E. Riverside Dr., Jupiter, FL (US) 33469

( * ) Notice: Subject to any disclaimer, the term of this patent is extended or adjusted under 35 U.S.C. 154(b) by 44 days.

(21) Appl. No.: 10/932,274

(22) Filed: Sep. 1, 2004

(65) Prior Publication Data

US 2006/0042533 A1 Mar. 2, 2006

(51) Int. Cl.
*B63B 21/00* (2006.01)

(52) U.S. Cl. ..... 114/230.15; 114/230.2

(58) Field of Classification Search ..... 114/230.1, 114/230.11, 230.15–230.29, 219, 221 R, 114/249, 250; D12/168; 405/212–216; 280/458; 293/27

See application file for complete search history.

(56) References Cited

U.S. PATENT DOCUMENTS 3,492,963 A * 2/1970 Kaiser ..... 114/230.16
3,853,084 A * 12/1974 Kedar ..... 114/219
3,863,591 A * 2/1975 Wild ..... 114/230.26
4,453,487 A * 6/1984 Vinnari ..... 114/249
4,656,961 A * 4/1987 Hellkamp ..... 114/230.18
4,781,138 A * 11/1988 Hay ..... 114/221 R
4,977,846 A * 12/1990 Landa et al. ..... 114/230.17
5,398,634 A * 3/1995 Eagan ..... 114/230.1
5,575,234 A * 11/1996 Dysarz ..... 114/230.27
5,634,421 A * 6/1997 Velarde ..... 114/230.15

* cited by examiner

*Primary Examiner*—Ajay Vasudeva
(74) *Attorney, Agent, or Firm*—McHale & Slavin PA

(57) ABSTRACT

A boat mooring device comprises two PVC pipes pivotally joined at a common midpoint to be selectively positionable from a coextensive linear configuration to an X-shaped configuration. Each pipe has a segment of nylon line extending therethrough and secured therein. The device includes a first pair of line anchoring structures adapted for spaced-apart attachment to a docking structure, and a second pair of line anchoring structures adapted for spaced-apart attachment to a watercraft. In use, the pipes are arranged in an X-shaped configuration and the ends of the nylon lines are attached to the anchoring structures on the dock and watercraft. Each pair of line anchoring structures are spaced apart at a distance approximately equal to half the length of the pipes. In this arrangement, the pipes form an angle of approximately 60° with respect to one another, which provides the optimal configuration for maintaining the moored boat in position.

20 Claims, 3 Drawing Sheets

WATERCRAFT MOORING DEVICE

FIELD OF THE INVENTION

The present invention relates to a device for securing floating watercraft to a dock or pier; and more particularly to a mooring device that will provide for vertical changes in the position of the watercraft in relation to the dock while preventing the watercraft from contacting the dock.

BACKGROUND OF THE INVENTION

There are many different systems in the prior art for standoff mooring of a boat to a dock or pier. These systems serve to prevent the boat from contacting the dock or pier to prevent damage which could be incurred from rough seas, high winds, tidal changes etc. Fenders are commonly used to protect boats moored to a dock. Fenders are usually made of a rubber-like plastic and filled with air under low pressure. Some are sealed, others can be inflated to higher pressures with a hand pump. Fenders generally have an eye molded in at each end for attaching a short length of light line used to suspend them along the side of a boat.

Fenders can be very effective for preventing contact between moored boats or the boat and the dock, however fenders can become displaced by vertical motion of the boat. This can result in damage to the boat when the dock contacts the boat above or below the fender. Another drawback is that the fenders are bulky, and on a relatively small boat (10–25 feet in length) take up a large percent of the available storage space.

There are several systems for standoff mooring disclosed in the prior art. U.S. Pat. No. 5,575,234 discloses a device to fix a floating boat to a dock that allows the boat to move up and down freely in the water. The device includes two elongated arms that are fixed to a cleat on the boat which extend to the dock forming a triangle. The device can only be used on a wooden dock constructed of lateral planks since the dock attachment fits in the slots between the planks.

U.S. Pat. No. 4,781,138 discloses a standoff mooring bar for a boat which is adjustable in length. The device must be attached to upright pylons, which may not be present in every docking situation.

U.S. Pat. No. 4,977,846 discloses a mooring device which comprises a mounting bracket which may be attached to a dock in various positions and provides for pivotal attachment of a mooring arm to the mounting bracket. The mooring arm comprises an inner hollow elongated member telescoping within an outer elongated hollow member.

In each of the above prior art patents, at least two of the disclosed devices must be used in a parallel arrangement to properly moor the boat. It would be highly desirable to provide a simplified system wherein standoff mooring could be accomplished with a single device.

The present invention as disclosed herein overcomes the disadvantages of the prior art systems by providing a lightweight device of economic design which accomplishes standoff mooring of a boat while allowing for vertical differentials in the distance between the boat and dock, and which also requires that only a single device be employed, thus providing ease of installation and storage.

SUMMARY OF THE INVENTION

Accordingly, it is an objective of the instant invention to provide a boat mooring device which maintains adequate distance between the boat and the dock or pier to protect both from damage.

It is a further objective of the instant invention to provide a boat mooring device which provides a vertical hinge action to accommodate variations in relative parallel distance due to changing tidal heights, as well as fore and aft movement of the boat.

It is yet another objective of the instant invention to provide a boat mooring device designed for use with smaller boats (less than 25 feet), and which is small and compact in size allowing for convenient storage.

It is a further objective of the present invention to provide a boat mooring device which requires only a single device to moor the boat.

It is a still further objective of the invention to provide a boat mooring device which can be collapsed for efficient storage.

It is yet another objective of the instant invention to provide a boat mooring device which is lightweight and inexpensive to manufacture.

It is a further objective of the present invention to provide a boat mooring device having an attachment means which can be used on any size or type of dock.

In accordance with the above objectives, an improved boat mooring device comprises two rigid tubular members, preferably PVC pipe material, which are of equal length and are pivotally joined at a common midpoint by a fastener extending therethrough so as to be selectively positionable from a coextensive linear configuration to an X-shaped configuration. Each tubular member has a segment of nylon line having a length greater than the tubular members extending therethrough. End caps are fitted over the open ends of the tubular members which include coaxial apertures sized to allow the insertion of the nylon line therethrough, and the lines can be maintained in the tubular members by knotting the lines adjacent the end caps.

The device includes a first pair of line anchoring structures adapted for spaced-apart attachment to a docking structure, and a second pair of line anchoring structures adapted for spaced-apart attachment to a watercraft. In the preferred embodiment, the first pair of line anchoring structures are a pair of dock-mounted brackets which are each formed as a flat plate having, forward, rearward and opposing side edges. The first pair of brackets include a plurality of mounting apertures proximate the rearward edge which are adapted to receive fastening structures therethrough, and a plurality of line receiving apertures proximate the forward edge. The brackets are mounted on the dock so that the line receiving apertures extend beyond the edge of the dock. The preferred embodiment includes three linearly arranged apertures, with a larger aperture in the center and smaller apertures proximate the side edges, the larger aperture being sized to receive a double loop of line.

The second pair of line anchoring structures are preferably a pair of watercraft-mounted brackets which each include a planar base and a plurality of mounting apertures adapted to receive fastening structures. The watercraft-mounted brackets can include a line securing structure contiguous to said planar base which extends upwardly therefrom and includes a plurality of line receiving apertures extending therethrough. The line securing structure is a planar rectangular portion normal to the planar base portion. The line securing structure preferably has three linearly arranged apertures comprising a center aperture and two side apertures, with the center aperture being somewhat larger so a loop of line can be threaded therethrough.

In use, the tubular members are arranged in an X-shaped configuration, and the four ends of the nylon lines are respectively attached to the first pair of line anchoring structures on the dock and the second pair of line anchoring structures on the watercraft. Each pair of line anchoring structures are in a spaced apart relationship on both the dock and the watercraft at a distance approximately equal to half the length of the tubular member. In this arrangement, the tubular members form an angle of approximately 60° with respect to one another and the dock or boat, which provides the optimal configuration for maintaining the moored boat in position.

The mooring device of the invention is preferably used with watercraft in the size range of 10–25 feet in length. The device provides a variable parallel separation of the watercraft in relation to the dock due to tidal changes or wave action. The configuration of the device restricts the fore and aft movement of the water craft in relation to the fixed dock. These fore and aft forces can also be the result of tidal changes, wave action or wind forces.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
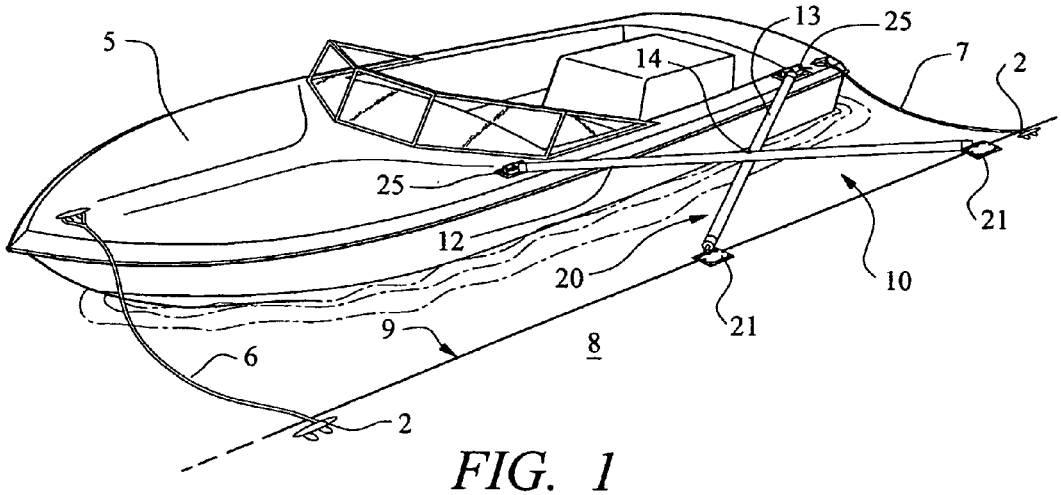
FIG. 1 illustrates the boat mooring device according to a preferred embodiment of the invention in which the device is shown in use securing a boat to a docking structure.

FIG. 1 illustrates a preferred embodiment of the boat mooring device 10 of the invention securing a boat 5 to a dock 8. The boat mooring device 10 is used in combination with first and second guy ropes 6 and 7 which extend from the bow and stem of the boat and are attached to cleats 2 in the typical arrangement. The boat mooring device of the present invention, while useful with any length vessel, is generally intended for use with a small watercraft having a length of about 25 feet or less, including power boats, sail boats, pontoon boats, etc. The device 10 maintains a standoff separation between the boat and dock, and also allows variations in the relative vertical position of the watercraft with respect to the dock. In this way, an adequate separation distance is maintained during varying wind, wave action, and tidal height conditions. As will be explained in detail hereinafter, the device of the invention functions as a hinge to accommodate vertical changes in the position of the watercraft in relation to the dock.

In the practice of the invention, line anchoring structures are permanently attached to a docking structure and the watercraft in a spaced apart arrangement. The terms "dock" and "docking structure" as used herein can be any type of structure having a configuration and location suitable for boat mooring, and can include docks, piers, sea walls, floating structures, floating dock assemblies, or other watercraft. As shown in FIG. 1, the device 10 includes a pair of boat mounted brackets 25, in spaced apart relation, attached to one side of the boat 5. In a preferred installation configuration, one of the boat brackets 25 is installed toward the stem section of the boat 5. A pair of brackets 25 can be mounted to both the starboard and port sides of the boat 5 to provide directional flexibility when docking. The device 10 also includes a pair of dock-mounted brackets 21 attached to the dock 8 in parallel alignment with the edge 9 of the dock and spaced apart a distance approximately equal to the spacing distance between the boat brackets 25.

Figure 3:
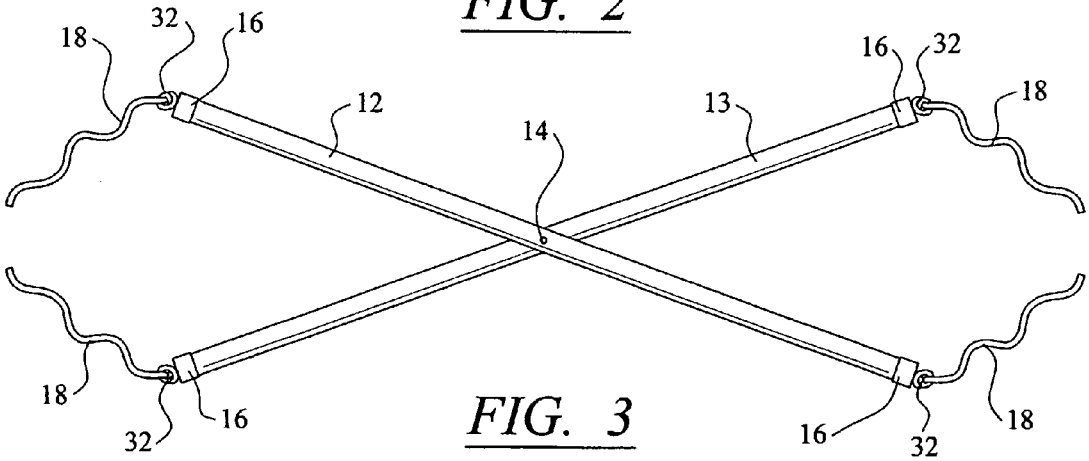
FIG. 3 illustrates the fender assembly according to a preferred embodiment of the invention.

A fender assembly 20 is attached to the four line anchoring structures, and is shown detached in FIG. 3. The fender assembly 20 includes a first tubular member 12 and a second tubular member 13 which are pivotally joined at a common midpoint by a fastener 14 extending therethrough so as to be selectively positionable from a coextensive linear configuration to an X-shaped configuration. The tubular members 12 and 13 which may be constructed of a variety of materials such as aluminum, plastic, fiberglass, polycarbonate, graphite and the like, are equal in length, and are preferably approximately 60 inches long. As shown in cross-section in FIG. 4, the fastener 14 may be a stainless steel bolt or the like, attached with, for example, one or more washers and nuts 45 which permits the tubular members to be freely rotatable with respect to one another. In the preferred embodiment, the tubular members 12 and 13 are segments of polyvinyl chloride (PVC) pipe. A preferred size is 1¼" pipe.

Figure 4:
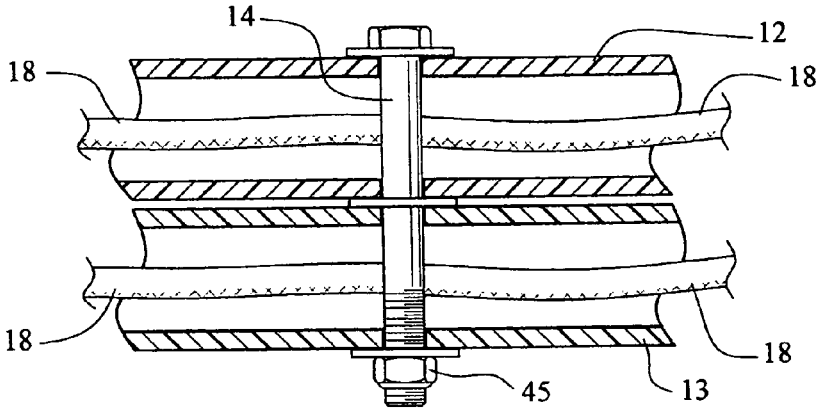
FIG. 4 illustrates the fastening means used to pivotally connect the tubular members of the fender assembly.

As can be best seen in FIG. 4, two segments of nylon line 18 are respectively inserted through the tubular members 12 and 13 and positioned to the side of the fastener 14. Referring again to FIG. 1, it is seen that the two segments of nylon line 18 both have a length greater than the length of the tubular members 12 and 13 so that the ends of the two nylon lines 18 extend outside of the tubular members 12, 13. The four open ends of the tubular members 12, 13 have end caps 16 fitted thereon. The end caps 16 are preferably standard PVC end caps for pipes which are press fit onto the open ends. Each end cap 16 includes a coaxially aligned aperture 15 (shown in FIGS. 6 and 7) which is adapted to receive nylon lines 18 therethrough. The nylon lines 18 can be maintained in tying knots 32 in the lines adjacent the end caps 16. However, any other suitable securement means can be used to fix the lines 18 inside the tubular members 12 and 13. In the preferred embodiment, the lines 18 are ⅜ inch nylon line.

Figure 2:
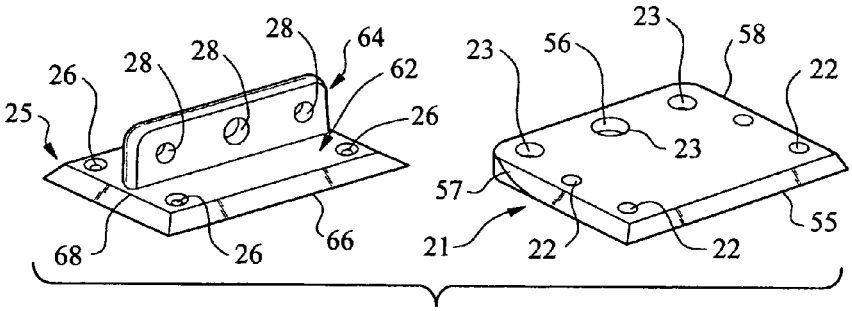
FIG. 2 illustrates a set of mounting brackets for the device of the invention.

To moor a boat, the fender assembly 20 is arranged in an X-configuration and the first and second ends of the two lines are attached to the fixedly mounted line anchoring structures on the dock and boat. The line anchoring structures can have any desired configuration which can be securely mounted to the dock or boat and which will maintain the lines therein. The preferred configurations for the line anchoring structures are shown in FIG. 2, namely boat-mounted bracket 25 and dock-mounted bracket 21.

Figure 7:
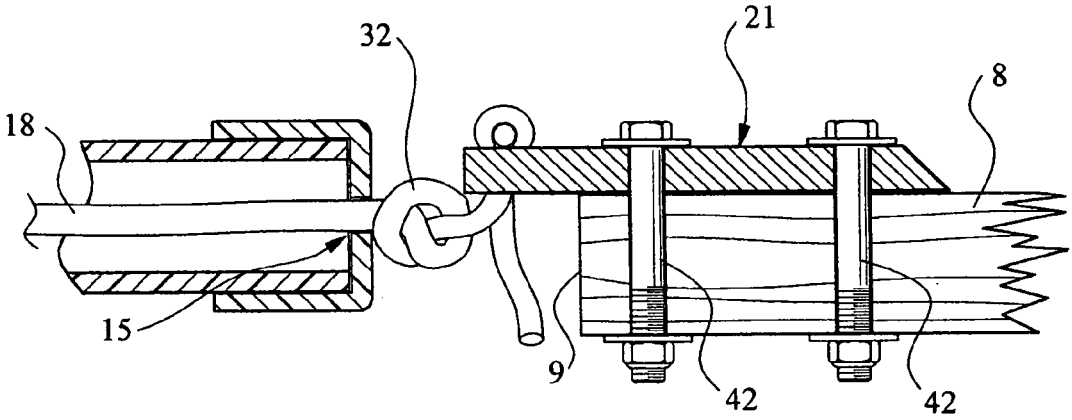
FIG. 7 is a side view in partial cross section of the fender assembly as attached to one of the dock-mounted line receiving brackets.

In the preferred embodiment, the dock-mounted bracket 21 has a planar rectangular configuration with a forward edge 56, rearward edge 55 and opposing side edges 57 and 58. A plurality of mounting apertures 22 are proximate the rearward edge 55 which is adapted to receive fastening structures therethrough. As seen in FIG. 7, bolts 42 can be inserted through the mounting apertures 22 and are seated within the dock 8. A plurality of line receiving apertures 23 are proximate the forward edge 56. In the illustrated embodiment, there are three line receiving apertures 23, with one in the longitudinal center and two near the opposing side edges 57 and 58. As will be explained below, the center aperture 23 is preferably slightly larger that the outer apertures 23 in order to accommodate a double loop of line. As shown in FIG. 7, the dock-mounted brackets 21 are mounted to the dock 8 so that the line receiving apertures extend over the edge 9 of the dock so a line can be threaded through the apertures 22 and secured therein.

Figure 6:
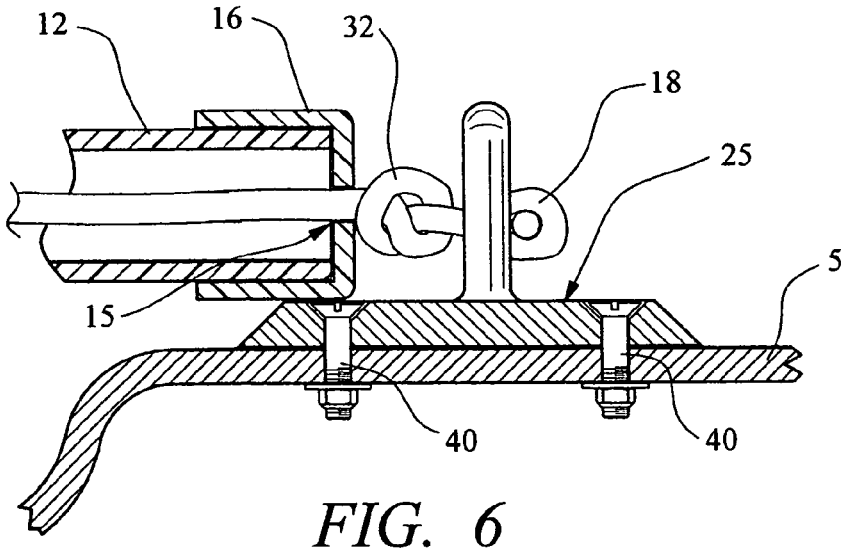
FIG. 6 is a side view in partial cross section of the fender assembly as attached to one of the boat-mounted line receiving brackets.

Referring again to FIG. 2, the watercraft-mounted bracket 25 preferably has a planar base 62 and a plurality of mounting apertures 26 adapted to receive fastening structures therethrough. FIG. 6 illustrates the bracket 25 secured to a boat 5 using screws which are inserted into the mounting apertures 26 and fixed to a portion of the boat 5. In the preferred embodiment, the watercraft-mounted brackets 25 each include a line securing structure 64 which is contiguous to the planar base 62. The line securing structure 64 extends upwardly from the planar base 62 and is preferably normal to the base 64. A plurality of line receiving apertures 28 extend through the line securing structure 64.

In a preferred embodiment, the planar base 62 of each of the watercraft mounted bracket 25 has a substantially rectangular configuration with a forward edge and rearward edges 66 and opposing side edges 68, with the forward and rearward edges 66 having a first longer length and the side edges 68 having a second shorter length. The mounting apertures 26 are positioned at the corners of the planar base 62. The line securing structure 64 preferably has a rectangular configuration which is normal to the planar base portion 62, and has a longitudinal length equal to the forward and rearward edges 66. The line securing structure 64 may be positioned to intersect the side edges so that the bracket 25 is contiguous with or offset about the longitudinal center to accommodate the end cap 16. In the illustrated embodiment, the line securing structure 64 includes three line receiving apertures 28 which are linearly aligned, with a larger aperture 28 in the longitudinal center sized to receive a double loop of line and smaller apertures 28 near the side edges sized to receiving a single line therethrough.

Figure 5A:
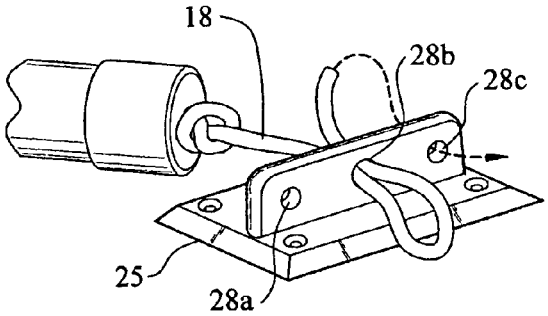
FIGS. 5A–D illustrate the sequence of steps for attaching the nylon line of the fender assembly to the watercraft-mounted line receiving brackets.
Figure 5B:
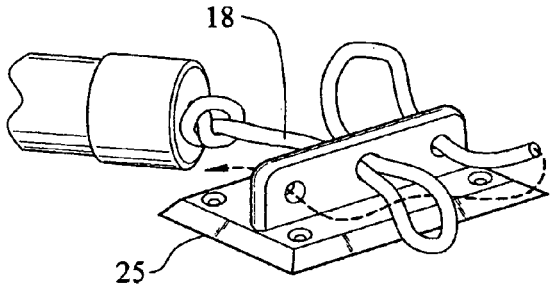
Figure 5C:
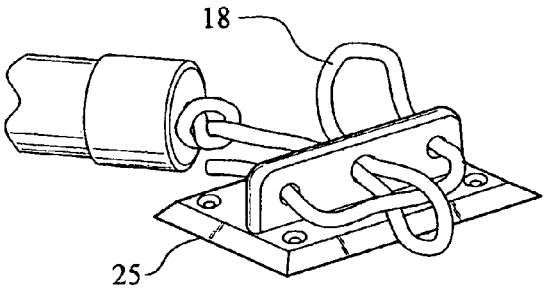
Figure 5D:
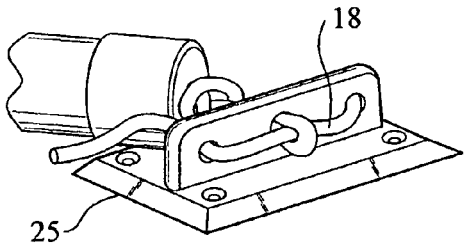

FIGS. 5A–D illustrate the preferred method of securing a line 18 to the watercraft-mounted bracket 25 of the illustrated embodiment of the invention. In FIG. 5A, the line 18 is folded on itself into a loop which is inserted through the larger center aperture 28*b*. The end of the line 18 is then inserted through single line aperture 28*c* (FIG. 5B), and is passed through the loop extending through the center aperture 28*b*. The line 18 is then inserted through the single line aperture 28*a* in the opposite direction (FIG. 5C), and the line 18 is pulled tight to secure the line 18 within the bracket 25. The same method is also used to secure the lines 18 to the dock-mounted brackets 21 of the preferred embodiment.

In order to achieve the optimal installation arrangement for the device 10 of the invention, the watercraft-mounted brackets and the dock-mounted brackets are respectively spaced apart on the boat and dock a distance equal to approximately half the length of the tubular members. In this preferred installation configuration, the tubular members 12 and 13 each form an approximate 60° angle with respect to each other and the line of the dock and boat. In the preferred embodiment in which the tubular members 12 and 13 are approximately 60 inches in length, the watercraft mounted brackets are mounted approximately 30 inches apart on the boat, an the dock mounted brackets are mounted to be aligned with the edge of the dock approximately 30 inches apart. This installation permits a maximum change in the relative vertical height of the boat with respect to the dock of up to about 4 feet. The device 10 thus installed will provide adequate separation (e.g. 40 inches for a 3 foot differential, 28 inches for a 4 foot differential) to prevent damage to the boat and docking structure. Further, the point of attachment of the lines 18 to the four line anchoring structures provide a hinge action which accommodates limited fore and aft movement of the boat which alleviates stress exerted on the fender assembly 20.

When not in use, the fender assembly 20 of the invention can be collapsed to a linear configuration and easily stored onboard the vessel. The compact size and lightweight materials make the device 10 of the invention ideal for use on small watercraft (less that 25 feet) which may have limited storage area.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification. One skilled in the art will readily appreciate that the present invention is well adapted to carry out the objectives and obtain the ends and advantages mentioned, as well as those inherent therein. The various methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings. Indeed, various modifications of the described modes for carrying out the invention which are obvious to those skilled in the art are intended to be within the scope of the following claims.

What is claimed is:

1. A boat mooring device, comprising:

a fender assembly comprising two rigid tubular members of equal length each having first and second ends and pivotally joined at a common midpoint by a fastener extending therethrough so as to be selectively positionable from a coextensive linear configuration to an X-shaped configuration, and two segments of line respectively threaded through each of said tubular members and having first and second ends; each of said two segments of line having a length greater than the length of the tubular members;

a first pair of line anchoring structures mounted to a docking structure in a spaced apart arrangement, said first pair of line anchoring structures adapted to securely receive said first ends of said segments of line;

a second pair of line anchoring structures mounted to a watercraft in a spaced apart arrangement, said second pair of line anchoring structures adapted to securely receive said second ends of said segments of line;

whereby said fender assembly is arranged in an X-shaped configuration, and said first and second ends of each of said lines are respectively attached to said first and second pairs of line anchoring structures thus providing a standoff mooring arrangement which permits variations in the relative vertical position of the watercraft with respect to the docking structure.

2. The device of claim 1, wherein said first pair of line anchoring structures comprises a pair of dock-mounted brackets adapted to be mounted to docking structure having an edge, wherein each of said pair of dock-mounted brackets are formed as a flat plate having, forward, rearward and opposing side edges, said brackets including a plurality of mounting apertures proximate said rearward edge adapted to receive fastening structures therethrough and a plurality of line receiving apertures proximate said forward edge and said brackets are adapted to be mounted to the docking structure such that said line receiving apertures extend beyond the edge of the docking structure whereby a line can be threaded through the apertures.

3. The boat mooring device of claim 2, wherein said plurality of line receiving apertures comprises three line receiving apertures.

4. The device of claim 1, wherein said second pair of line anchoring structures comprises a pair of watercraft-mounted line receiving brackets adapted for spaced-apart attachment to a watercraft, said brackets having a planar base and a plurality of mounting apertures adapted to receive fastening structures therethrough; said brackets each including a line securing structure contiguous to said planar base which extends upwardly therefrom wherein said line securing structure includes a plurality of line receiving apertures extending therethrough.

5. The boat mooring device of claim 4, wherein said plurality of line receiving apertures comprises three line receiving apertures.

6. The boat mooring device of claim 4, wherein said planar base of each of said watercraft mounted brackets has a substantially rectangular configuration with forward, rearward and opposing side edges defining four corners and said plurality of mounting apertures comprises four apertures positioned respectively proximate said four corners; and said line securing structure comprises a planar rectangular portion normal to said planar base portion.

7. The boat mooring device of claim 6, wherein said forward and rearward edges have a first longer length and said opposing side edges have a second shorter length, and said line securing structure has a longitudinal length equal to said first longer length.

8. The boat mooring device of claim 7, where said line securing structure is positioned to intersect said length of said side edges of said planar base portion.

9. The boat mooring device of claim 1, wherein each of said first and second ends of said tubular members have an end cap fitted thereon, each of said end caps including a coaxially aligned aperture adapted to receive said segments of line therethrough, whereby said line is maintained in place by placing knots in said lines adjacent said end caps.

10. The boat mooring device of claim 1, wherein said tubular members are formed from polyvinyl chloride (PVC).

11. The boat mooring device of claim 1, wherein said line is ⅜" nylon line.

12. A method for standoff mooring of a boat at a docking structure which accommodates continuous variations in vertical distance between the boat and docking structure, comprising:

providing two tubular members of equal length each having first and second ends and pivotally joined at a common midpoint by a fastener extending therethrough so as to be selectively positionable from a coextensive linear configuration to an X-shaped configuration, providing two segments of line each having a length greater than the length of the tubular members wherein each of the two segments of line have first and second ends;

inserting each said segment respectively through each said tubular member wherein said line ends extend freely beyond the ends of the tubular members;

providing a pair of dock-mounted brackets having a plurality of line receiving apertures therein dimensioned to have a line threaded and secured therethrough;

attaching the pair of dock-mounted brackets to a docking structure having an edge wherein the brackets are linearly arranged with respect to the edge and spaced apart at a distance approximately equal to half the length of the tubular members, providing a pair of boat-mounted brackets having a plurality of line receiving apertures therein dimensioned to have a line threaded and secured therethrough;

attaching the pair of boat-mounted brackets to a boat wherein the brackets are spaced apart a distance approximately equal to half the length of the tubular members;

inserting the first ends of the two segments of line respectively through the plurality of line receiving apertures in each of the dock-mounted brackets to secure the lines therein; and inserting the second ends of the two segments of line respectively through the plurality of line receiving apertures in each of the boat-mounted to secure the lines therein;

whereby the two tubular members are arranged in an X-shaped configuration by pivoting the tubular members about the midpoint to form an angle of approximately 60° with respect to one another.

13. The method of claim 12, wherein the tubular members are formed from polyvinyl chloride (PVC.).

14. The method of claim 12, wherein the two segments of line are ⅜" nylon line.

15. The method of claim 12, further comprising the step of providing an end cap for each of the first and second ends of the tubular members wherein each of the end caps includes a coaxially aligned aperture adapted to receive the segments of line therethrough, and said step of inserting the two segments of line through the tubular members further comprises the step of threading the lines through the apertures in the end caps and maintaining the lines in place by knotting the lines adjacent the end caps.

16. The method of claim 12, wherein the pair of dock-mounted brackets are each formed as a flat plate including forward, rearward and opposing side edges and include a plurality of mounting apertures proximate the rearward edge adapted to receive fastening structures therethrough, and the plurality of line receiving apertures comprises three apertures proximate the forward edge; and said step of attaching the brackets to a dock structure further includes the steps of positioning the brackets so that the line receiving apertures are beyond the edge of the docking structure and inserting fastening structures through the mounting apertures to secure the brackets to the docking structure.

17. The method of claim 12, wherein the pair of boat-mounted brackets each include a planar base portion having a substantially rectangular configuration with forward, rearward and opposing side edges defining four corners; and the planar base portion includes four mounting apertures positioned respectively proximate the four corners and a line attachment structure contiguous thereto and extending upwardly therefrom wherein the plurality of line receiving apertures extend through the line attachment structure.

18. The method of claim 17, wherein the line receiving structure has a rectangular configuration and is normal to the planar base portion.

19. The method of claim 18, wherein the forward and rearward edges of the planar base portion have a first longer length and the opposing side edges have second shorter length, and the line securing structure has a longitudinal length equal to the first longer length of the planar base portion.

20. The method of claim 18, where the line securing structure is positioned to intersect the length of the side edges of the planar base portion.

* * * * *